US011376465B2

(12) United States Patent
Scheinberg

(10) Patent No.: US 11,376,465 B2
(45) Date of Patent: Jul. 5, 2022

(54) NEUROMUSCULAR TRAINING APPARATUS AND METHOD

(71) Applicant: Russell Todd Scheinberg, Portland, OR (US)

(72) Inventor: Russell Todd Scheinberg, Portland, OR (US)

( * ) Notice: Subject to any disclaimer, the term of this patent is extended or adjusted under 35 U.S.C. 154(b) by 596 days.

(21) Appl. No.: 16/237,671

(22) Filed: Dec. 31, 2018

(65) Prior Publication Data

US 2019/0209889 A1 Jul. 11, 2019

Related U.S. Application Data

(63) Continuation of application No. 16/154,607, filed on Oct. 8, 2018, now abandoned.
(Continued)

(51) Int. Cl.
*A63B 21/00* (2006.01)
*A63B 22/00* (2006.01)
(Continued)

(52) U.S. Cl.
CPC .... *A63B 21/4039* (2015.10); *A63B 21/00047* (2013.01); *A63B 21/00178* (2013.01); *A63B 21/00185* (2013.01); *A63B 21/02* (2013.01); *A63B 21/068* (2013.01); *A63B 21/4003* (2015.10); *A63B 21/4007* (2015.10); *A63B 22/0087* (2013.01); *A63B 23/025* (2013.01); *A63B 23/0233* (2013.01);
(Continued)

(58) Field of Classification Search
CPC ..... A63B 21/4039; A63B 21/00185; A63B 21/068; A63B 71/0622; A63B 23/0233; A63B 21/00047; A63B 21/00178; A63B 21/4003; A63B 21/4007; A63B 23/025; A63B 21/02; A63B 22/0087; A63B 2071/0655; A63B 2208/02; A63B 2022/0094; A63B 2202/0092
See application file for complete search history.

(56) References Cited

U.S. PATENT DOCUMENTS 10,576,620 B1 * 3/2020 Chou ..... B25J 9/0006
2010/0286581 A1 * 11/2010 Hipp ..... A61F 5/055 602/18
2016/0107309 A1 * 4/2016 Walsh ..... A61H 1/0266 248/550

FOREIGN PATENT DOCUMENTS

DE 10238256 A1 * 3/2004 ..... A61F 5/0102

OTHER PUBLICATIONS

English Translation for DE-10238256-A1 (Year: 2004).*

* cited by examiner

*Primary Examiner* — Quang D Thanh
(74) *Attorney, Agent, or Firm* — Scheinberg & Associates, PC

(57) ABSTRACT

An apparatus and method for automating neuromuscular training may be used in conjunction with a human trainer or by a person training alone. The apparatus and method may be applied to various forms of neuromuscular training. The apparatus may be employed by a person desiring training in an environment with a human trainer as well as, or alternatively, in a home environment for personal training. Embodiments enable training of relative motions between body parts such as the head, neck, shoulders, upper torso, lower torso. These relative motions may be linear and/or angular. Pressure/sensor assemblies facilitate both the suggestion of desired motions as well as sensing of the person's neuromuscular response to these suggestions.

9 Claims, 12 Drawing Sheets

Related U.S. Application Data

(60) Provisional application No. 62/569,863, filed on Oct. 9, 2017.

(51) Int. Cl.

| | |
|---|---|
| ***A63B 23/025*** | (2006.01) |
| ***A63B 21/02*** | (2006.01) |
| ***A63B 21/068*** | (2006.01) |
| ***A63B 71/06*** | (2006.01) |
| ***A63B 23/02*** | (2006.01) |

(52) U.S. Cl.

CPC .. *A63B 71/0622* (2013.01); *A63B 2022/0092* (2013.01); *A63B 2022/0094* (2013.01); *A63B 2071/0655* (2013.01); *A63B 2208/02* (2013.01)

NEUROMUSCULAR TRAINING APPARATUS AND METHOD

CROSS-REFERENCE TO RELATED APPLICATIONS

This patent application is a continuation-in-part of U.S. patent application Ser. No. 16/154,607, filed Oct. 8, 2018, which claims priority from U.S. Provisional Patent Application 62/569,863, filed Oct. 9, 2017.

TECHNICAL FIELD

The present invention relates to training apparatus and methods, and in particular to apparatus and methods for automating neuromuscular training.

BACKGROUND

A major function of the brain is motor control, which involves coordination of the whole of the organism as well as of the parts, and includes translation of conscious planning into movement as well as unconscious adjustment to maintain posture and balance in activity. Inefficient motor control can result in over-tension or under-tension of certain sets of muscles during activity, and this can lead to inefficient movement, stiffness, stress, and a variety of other psychophysical symptoms.

Thus, the need to change and retrain aspects of motor control is a problem that has been addressed with different approaches. A person can change his or her motor control through self-coaching, for example, a pianist could tell himself to "be lighter" on the keys or a runner could tell herself to raise the knees higher, and through time and practice, the amount of force applied to the keys or the activity of the knees may be changed. However, a key feature of motor control is that the entire organism must be coordinated at the same time, and consciously modulating the motor control of one part often negatively affects coordinative motor control as a whole, resulting in inefficient motor control in another part of the body.

Each joint, the eyes, and the spatial awareness habitually tend towards certain states, and the set of these states is relatively stable over time, different for each person, and susceptible to change. Neuromuscular training is a method of changing the coordination of these states by:

1) consciously inhibiting (stopping, turning off) certain habit patterns (muscular habit patterns and also cognitive habit patterns like certain attitudes, emotions, etc.) that produce said states; and
2) consciously modulating one's cognitive processes (such as spatial and visual awareness, aka directing).

The states of the joints, eyes and spatial awareness described above are also highly interdependent, with one affecting the others in a complex manner. One type of neuromuscular training is the Alexander Technique, where it has been found that certain patterns of coordination are more conducive to health, learning and reduced levels of stress. Training to acquire these more favorable motor control patterns is a common goal of the neuromuscular training.

SUMMARY

The invention addresses the need to train the motor control of the parts while preventing unwanted and inefficient motor control of other parts and of the whole postural system. Basically, a stimulus is given such as moving the subject's arm, and undesirable motor control is detected with a pressure sensor stimulus may be subject initiated (standing up, moving arm, etc.) or may be applied by the gym (robotic arm moves wrist or applies a force to the back of the knees or to the back to the back of the head, prompting the subject to sit down). With the arm in a sling, the elbow resting part of the sling is the reference point, which makes for easy measurement. When trying to measure the primary curve or secondary curve in the back, 2 reference points have to be established and there is no outside reference point. This may suggest a way of categorizing different kinds of stimuli and measurements.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF EMBODIMENTS

Various embodiments of the invention provide an apparatus and method for automating neuromuscular training.

Some embodiments are operable for training of improved head and body posture. Some embodiments are operable for training of improved body motion and use of musculature.

Helmet Assembly

Some embodiments of the Neuromuscular Training Device comprise a helmet assembly 100 as illustrated in FIGS. 1-6.

Figure 1:
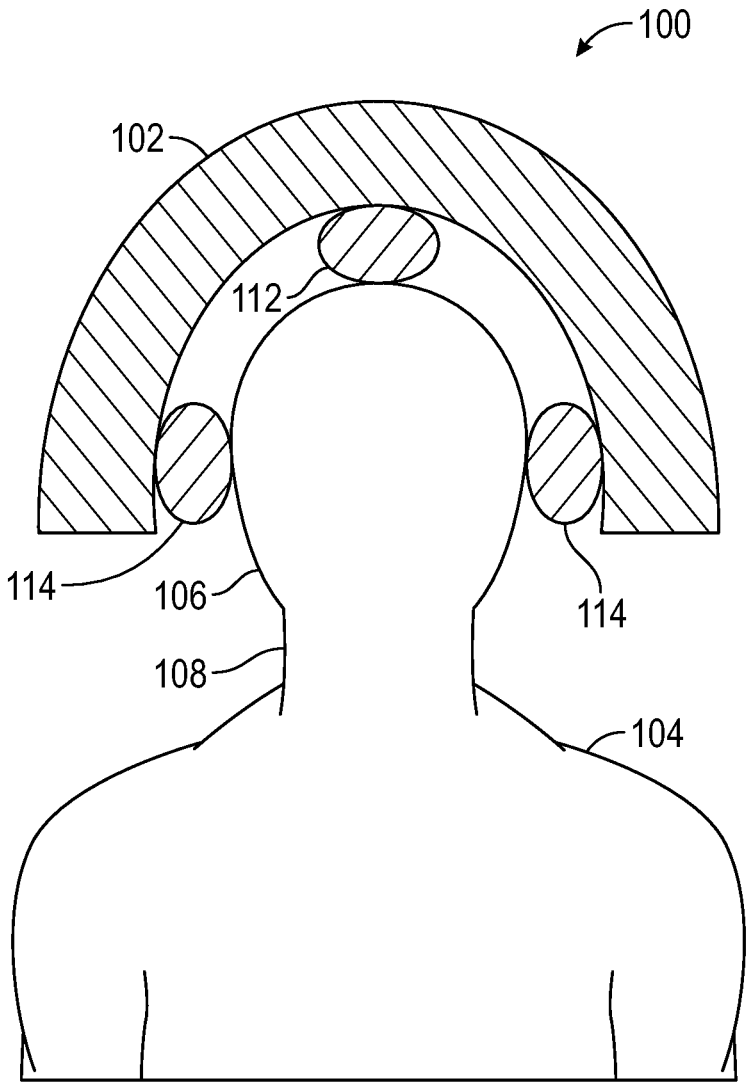
FIG. 1 shows a cross-sectional back view of a helmet assembly.
Figure 2:
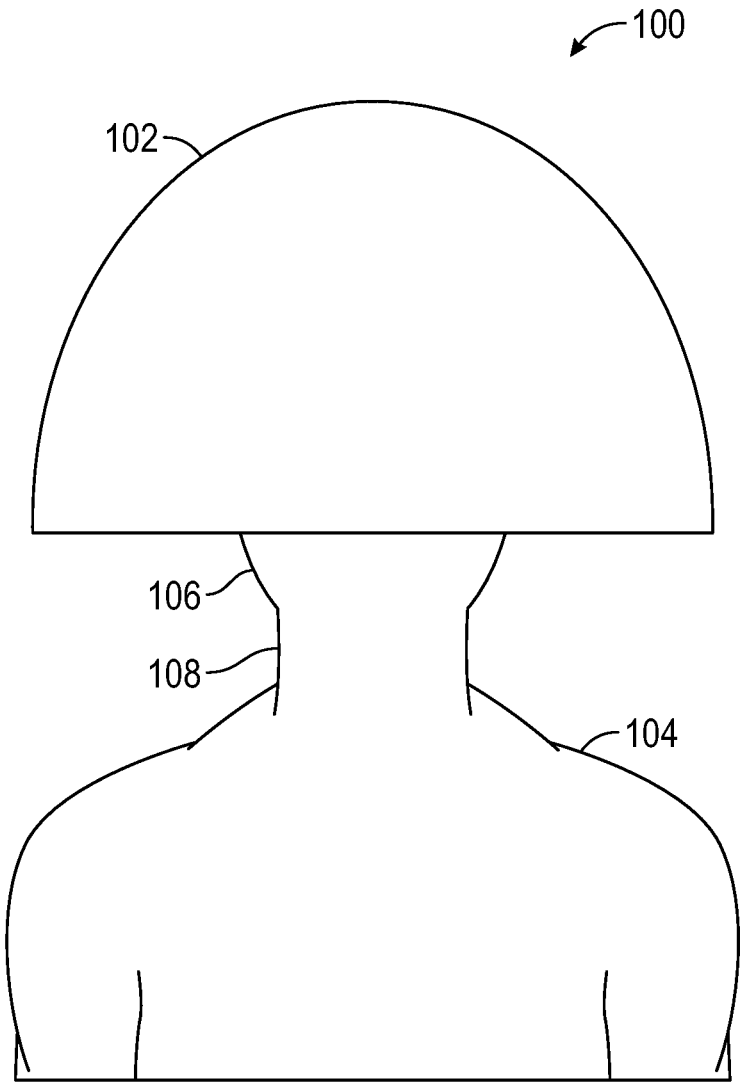
FIG. 2 shows a back view of the helmet assembly of FIG. 1.
Figure 3:
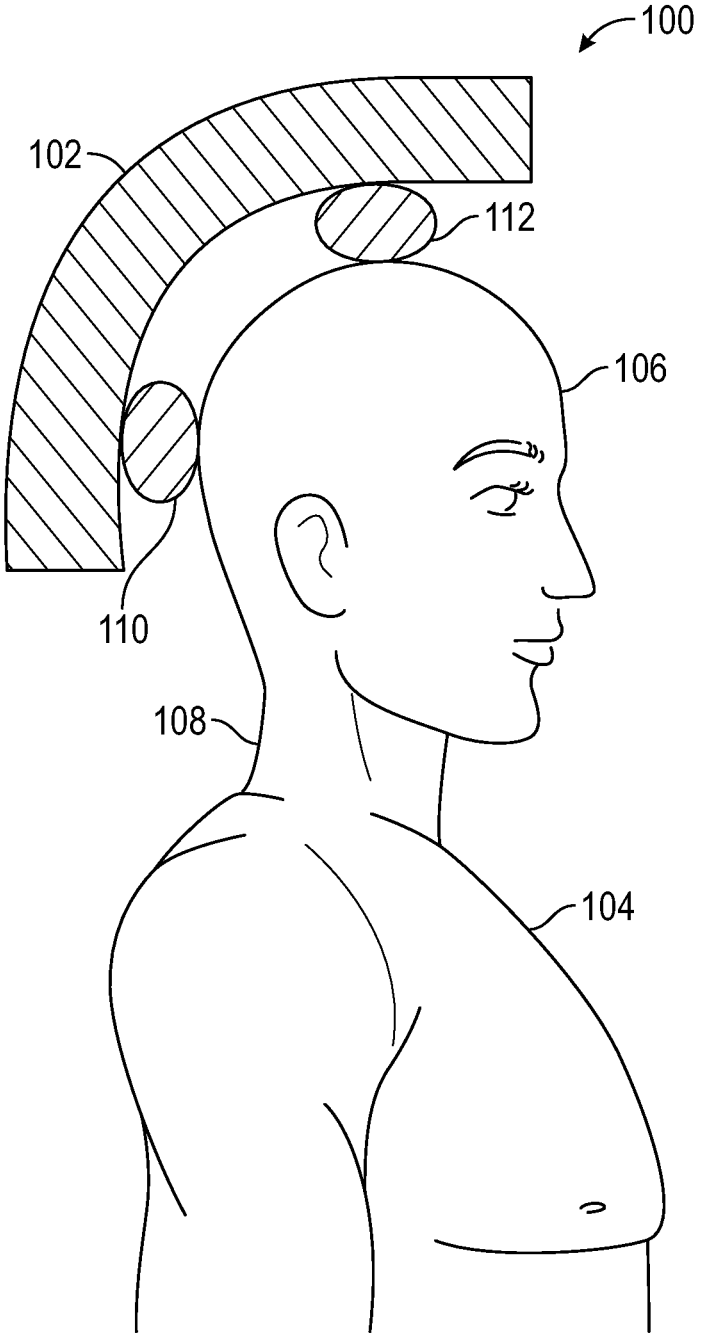
FIG. 3 shows a cross-sectional side view of the helmet assembly of FIG. 1.

FIG. 1 shows a cross-sectional back view of the helmet assembly 100 and FIG. 2 shows a back view of the helmet assembly 100. A person undergoing neuromuscular training with the NTA of embodiments is shown with a head 106, neck 108, and body 104. The helmet assembly 100 comprises a helmet shell 102, to which one or more pressure/sensor assemblies 110-114 may be attached (pressure/sensor 110 is shown in FIG. 3). Pressure/sensor assembly 112 is attached to a top inner surface of helmet shell 102 and is operable to sense up/down motion of head 106 with respect to the helmet shell 102. Pressure/sensor assemblies 114 are attached to two sides of the lower front inner surface of helmet shell 102 and are operable to sense side-to-side motion of head 106 with respect to helmet shell 102.

In some embodiments, one or more of pressure/sensor assemblies 110-114 may comprise a force-exerting device without a sensor. In some embodiments, one or more of pressure/sensor assemblies 110-114 may comprise a sensor without a force-exerting device. In some embodiments one or more of pressure/sensor assemblies 110-114 may comprise a force-exerting device and a sensor.

In some embodiments, the force-exerting devices within pressure/sensor assemblies 110-114 may comprise pneumatic bellows. In some embodiments, the force-exerting devices within pressure/sensor assemblies 110-114 may comprise hydraulic bellows. In some embodiments, force-exerting devices within pressure/sensor assemblies 110-114 may comprise electrically-excited actuators such as solenoids. Within pressure/sensor assemblies 110-114, other types of force-exerting devices also fall within the scope of the invention.

Figure 17:
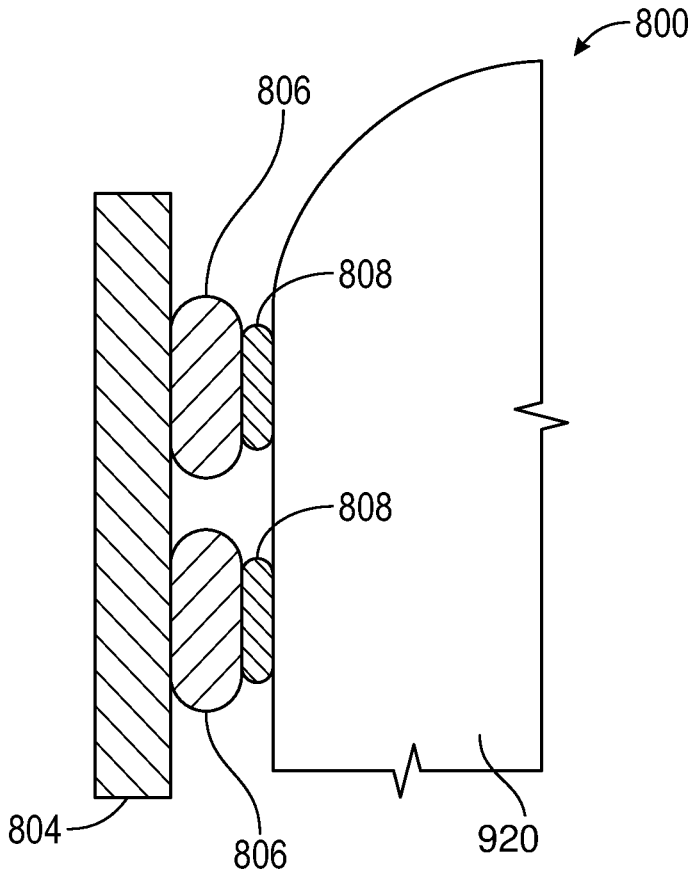
FIG. 17 shows a cross-sectional view of a pressure plate.

In some embodiments, the sensors within pressure/sensor assemblies 110-114 may comprise piezoelectric force sensors. In some embodiments, the sensors within pressure/sensor assemblies 110-114 may comprise compressive bellows force sensors which may detect the force by the pressure induced within a bellows in the force-exerting device. Within pressure/sensor assemblies 110-114, other types of sensors fall within the scope of the invention. Further details of embodiments of pressure/sensor assemblies are shown in FIG. 17.

Figure 4:
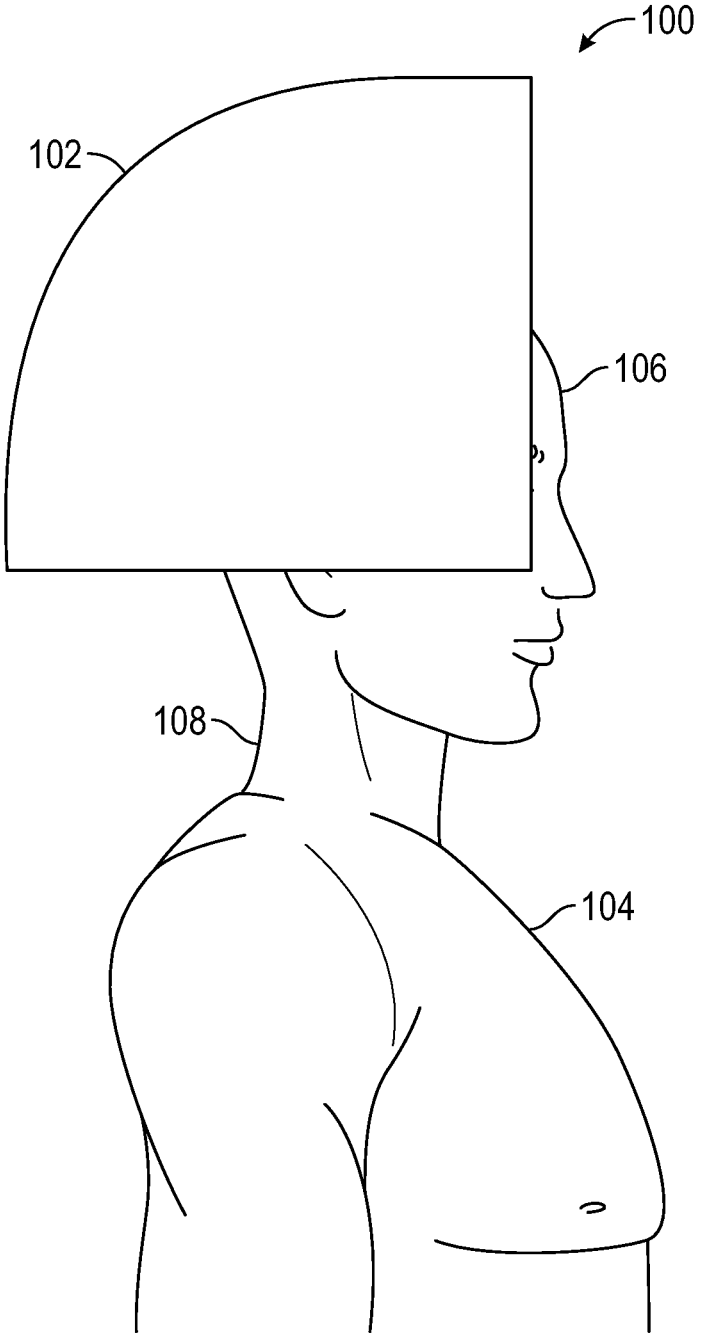
FIG. 4 shows a side view of the helmet assembly of FIG. 3.

FIG. 3 shows a cross-sectional side view of the helmet assembly of FIG. 1 and FIG. 4 shows a side view of the helmet assembly of FIG. 3. Pressure/sensor assembly 110 is attached to a lower rear inner surface of helmet shell 102 and is operable to sense front-back motion of head 106 with respect to the helmet shell 102.

Figure 5:
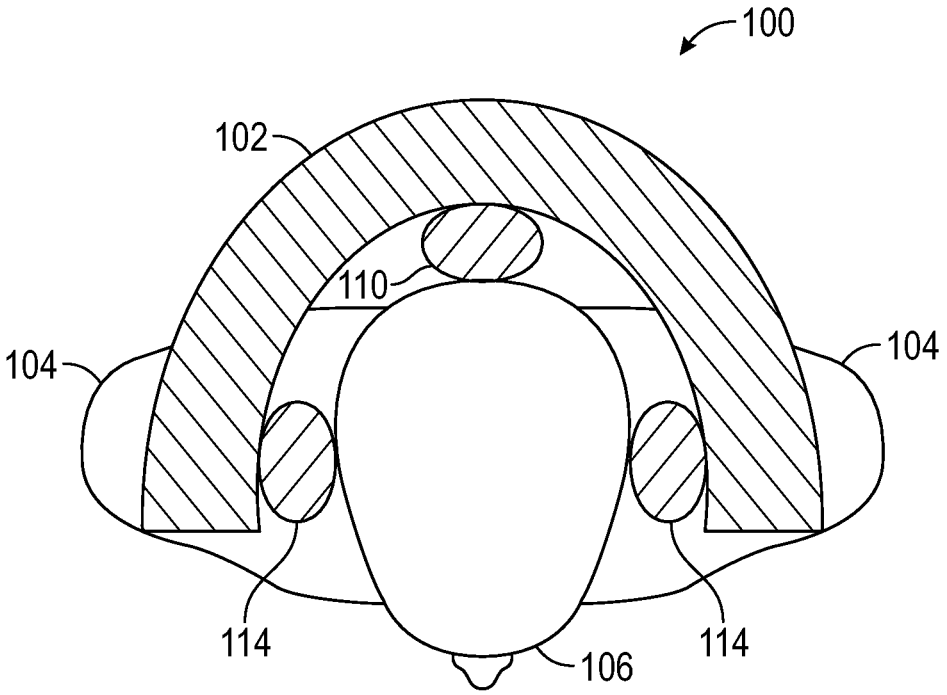
FIG. 5 shows a cross-sectional top view of the helmet assembly of FIG. 1.
Figure 6:
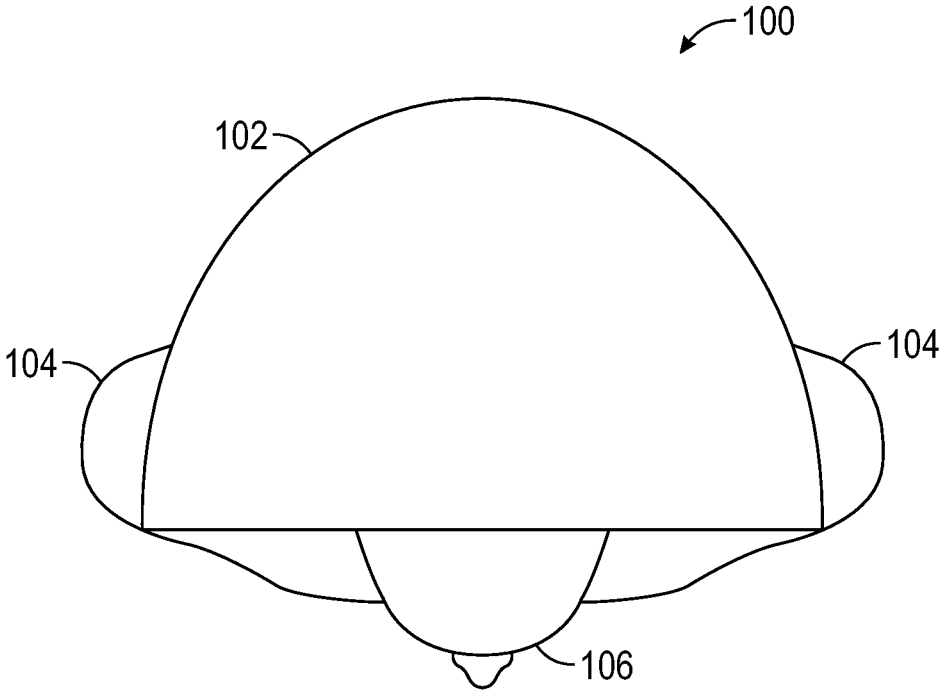
FIG. 6 shows a top view of the helmet assembly of FIG. 5.

FIG. 5 shows a cross-sectional top view of the helmet assembly of FIG. 1 and FIG. 6 shows a top view of the helmet assembly of FIG. 6.

The sensors within pressure/sensor assemblies 110-114 may be connected to a data processing device (not shown) such as a laptop computer, a tablet computer, a desktop computer, a smart phone, or other type of electronic data processing device. Data communication between the sensors and the data processing device may be conducted over wires or by wireless data transmission. Other data communication technologies also fall within the scope of the invention. Control of both the force-exerting devices and sensors within pressure/sensor assemblies 110-114 may be effected by electrical power connections, pneumatic connections, and/or hydraulic connections. Other types of control technologies also fall within the scope of the invention. Multiple types of control technologies may be employed for each of the pressure/sensor assemblies 110-114.

Pressure/sensor assemblies 110-114 may work in concert to sense generally linear motions of head 106 in the forward-backward, up-down, side-to-side directions simultaneously or individually. Additional pressure/sensor assemblies may be attached to the inner surface of helmet shell 102 to come into contact with head 106 at additional locations beyond the locations illustrated in FIGS. 1-6. Additional angular motions of head 106 with respect to helmet shell 102, such as various front-back and side-to-side tilting motions may also be detected by employing differential position sensing using multiple pressure/sensor assemblies together.

The force-exerting devices within pressure/sensor assemblies 110-114 may be operable to exert various degrees of pushing force against an outer surface of head 106. Low level forces may convey to the person undergoing neuromuscular training that they should move their head 106 in a particular direction. For example, the force-exerting device within pressure/sensor assembly 110 may convey to the person that they should move their head forward. Similarly, the force-exerting device within pressure/sensor assembly 112 may convey to the person that they should lower their head. The force-exerting devices within pressure/sensor assemblies 114 may convey to the person that they should move their head to either the right or left side, depending on which of the two pressure/sensor assemblies 114 is activated.

The sensors within each of pressure/sensor assemblies 110-114 may be sandwiched between the force-exerting devices of each pressure/sensor assembly and head 106 as illustrated in FIG. 17 for a pressure plate. Thus, if a force-exerting device is directed to expand in a direction towards head 106, and head 106 does not move as much as may be desired as part of the neuromuscular training, then the corresponding sensor may convey a certain data signal to the control computing device. Conversely, if a force-exerting device is directed to expand in a direction towards head 106, and head 106 does move as much as may be desired as part of the neuromuscular training, then the corresponding sensor may convey a corresponding different data signal to the control computing device. The control computing device may then compare the received data signal from the sensor with the desired data signal to determine the current effectiveness of the neuromuscular training process and, if necessary, a corrective response to improve the training status of the person.

Trunk Mount

Some embodiments of the Neuromuscular Training Device comprise a trunk mount 200 as illustrated in FIGS. 7-11. The trunk mount 200 may serve as the anchor or reference point for measurement of motions of the body of a person being trained, such as their head relative to their body, their shoulders relative to their torso, or their upper body relative to their lower body. These relative motions may comprise linear front-back, up-down, and/or side-to-side motions, as well as various angular motions such as leaning forward or backward, leaning side-to-side, or twisting the head relative to the torso, or twisting the upper portion of the torso relative to the lower portion of the torso, etc. Training of improved motion in any one or more of these types of motion may be comprised in the set of goals for the person's neuromuscular training.

Figure 7:
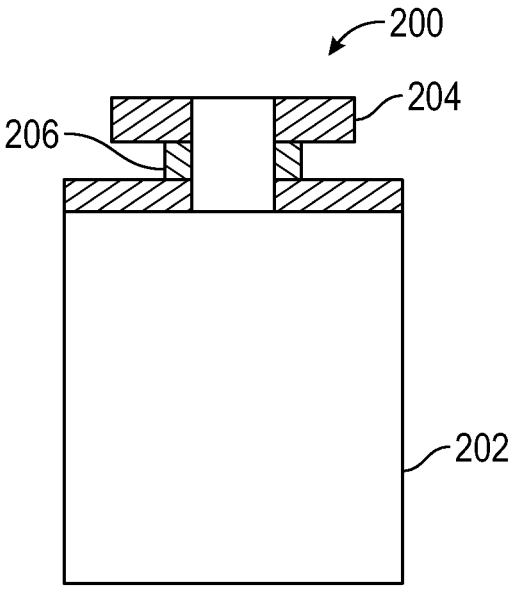
FIG. 7 shows a cross-sectional front view of a trunk mount.
Figure 8:
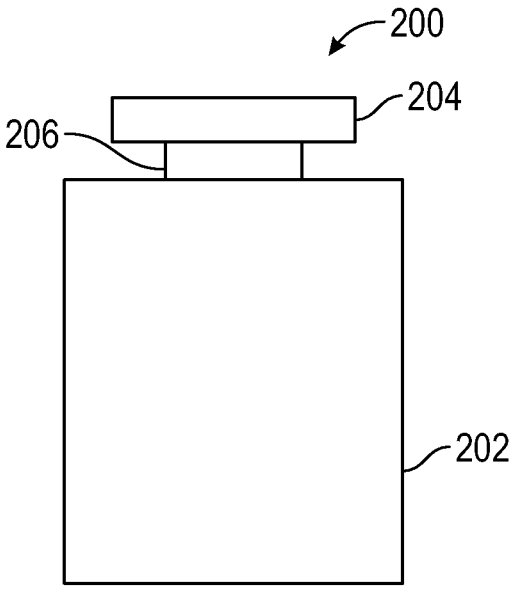
FIG. 8 shows a front view of the trunk mount of FIG. 7.
Figure 9:
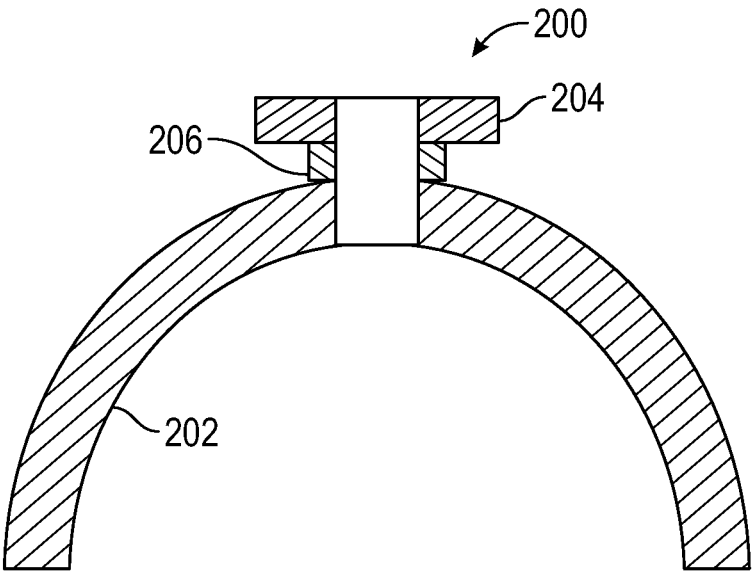
FIG. 9 shows a cross-sectional side view of the trunk mount of FIG. 7.
Figure 10:
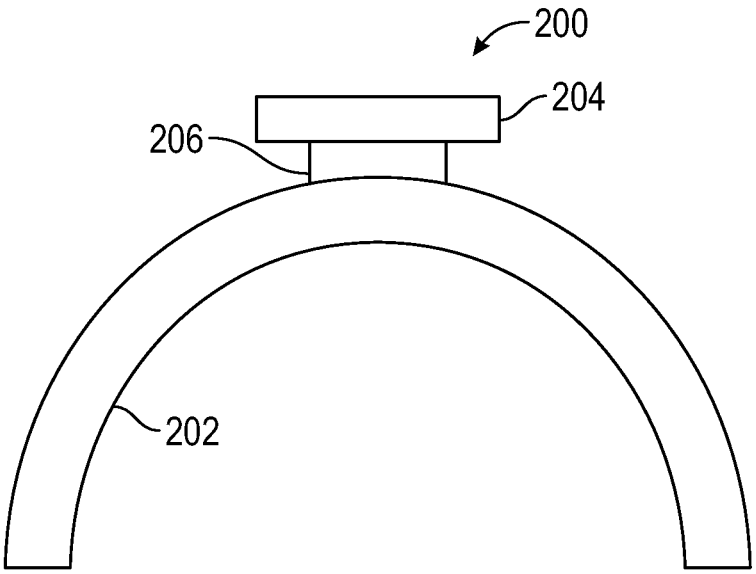
FIG. 10 shows a side view of the trunk mount of FIG. 7.
Figure 11:
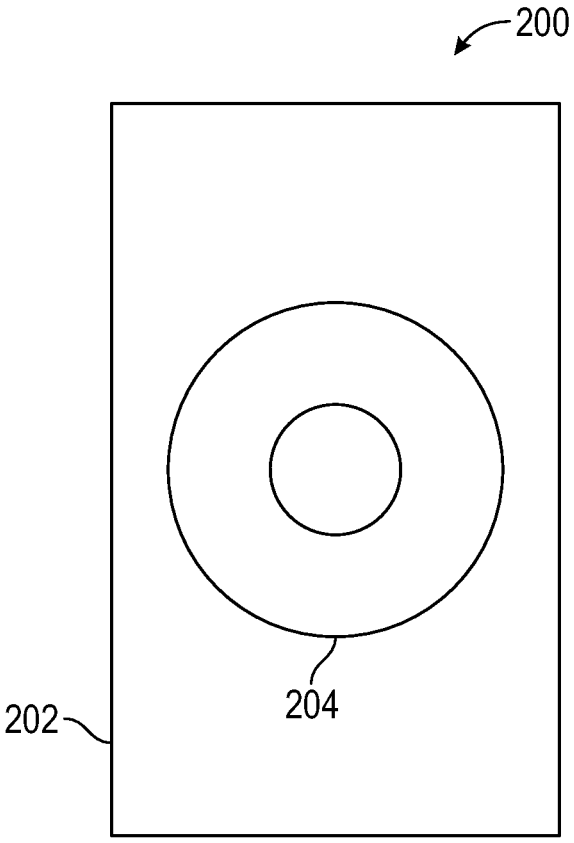
FIG. 11 shows a top view of the trunk mount of FIG. 10.
Figure 15:
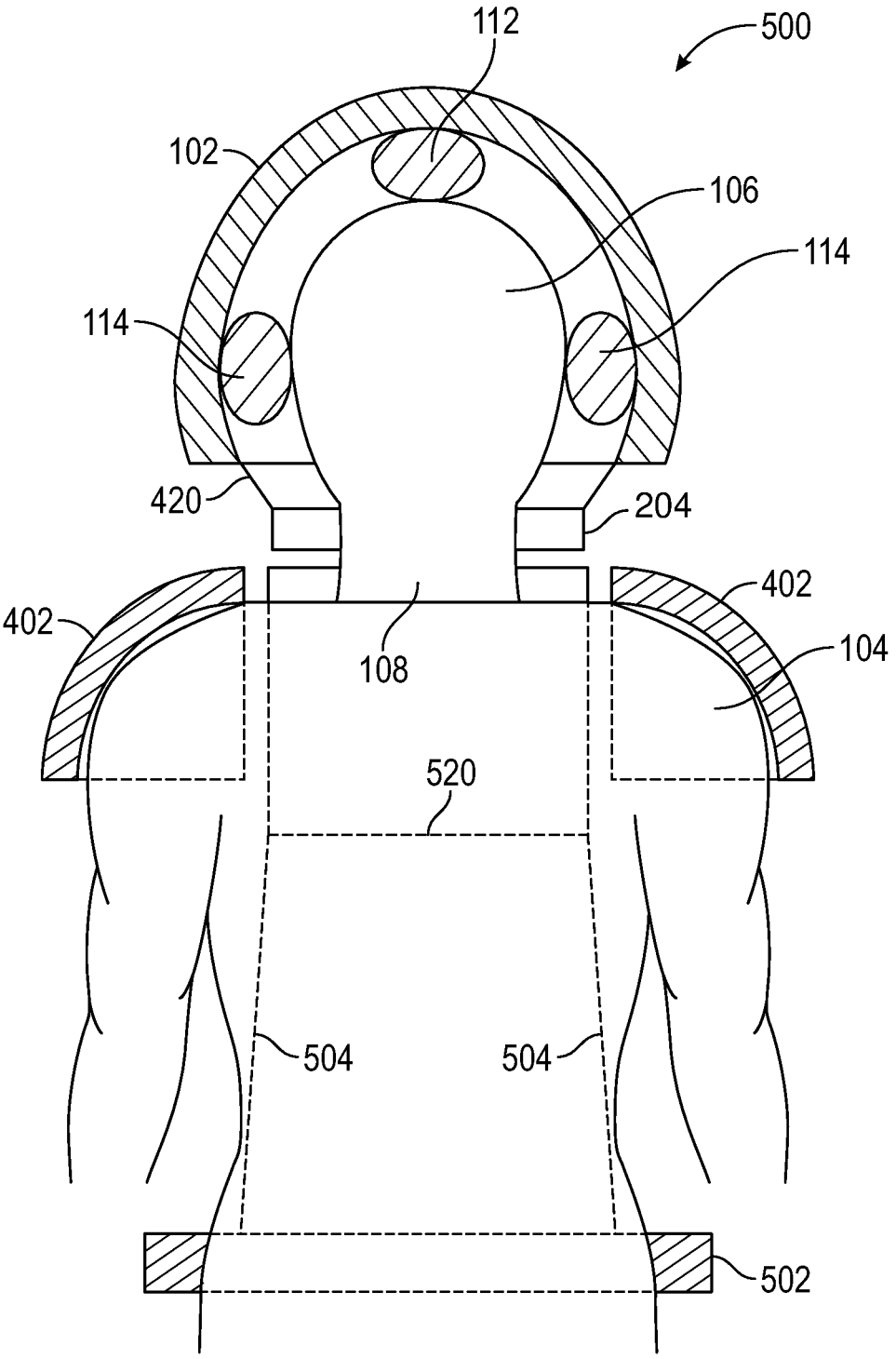
FIG. 15 shows a cross-sectional front view of a third embodiment of a neuromuscular training apparatus.

FIG. 7 shows a cross-sectional front view of trunk mount 200 and FIG. 8 shows a front view of trunk mount 200. FIG. 9 shows a cross-sectional side view of trunk mount 100 and FIG. 10 shows a side view of trunk mount 100. FIG. 11 shows a top view of trunk mount 100. FIG. 9 shows that harness 202. The cross-sectional side view in FIG. 9 shows trunk mount body 202 extending generally in an arc intended to extend from in front of the person's torso (the right side of FIG. 9), up and over the shoulders and then down at the back of the person's torso (the left side of FIG. 9). At the top neck ring 204 is shown, connected by neck tube 206 to trunk mount body 202. In use, as shown in FIG. 15, the person's neck would extend upwards through neck tube 206 and their head would be above neck ring 204. Various methods for enabling the person to put the trunk ring 200 on and to remove the trunk ring 200 fall within the scope of the invention. FIGS.

First Embodiment of a Neuromuscular Training Apparatus (NTA)

Figure 12:
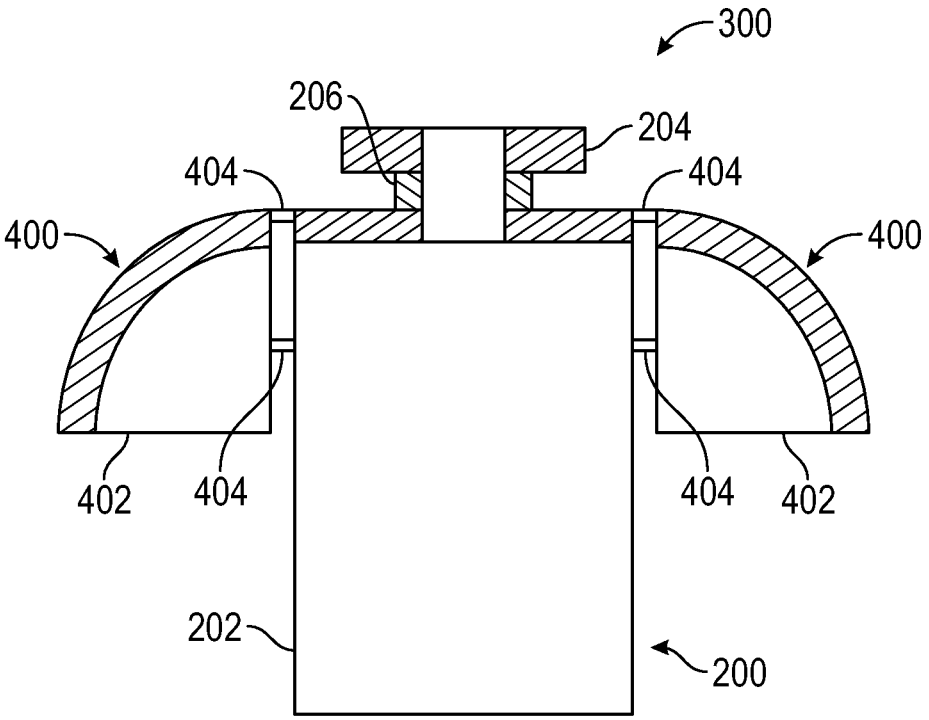
FIG. 12 shows a cross-sectional front view of a first embodiment of a neuromuscular training apparatus.
Figure 13:
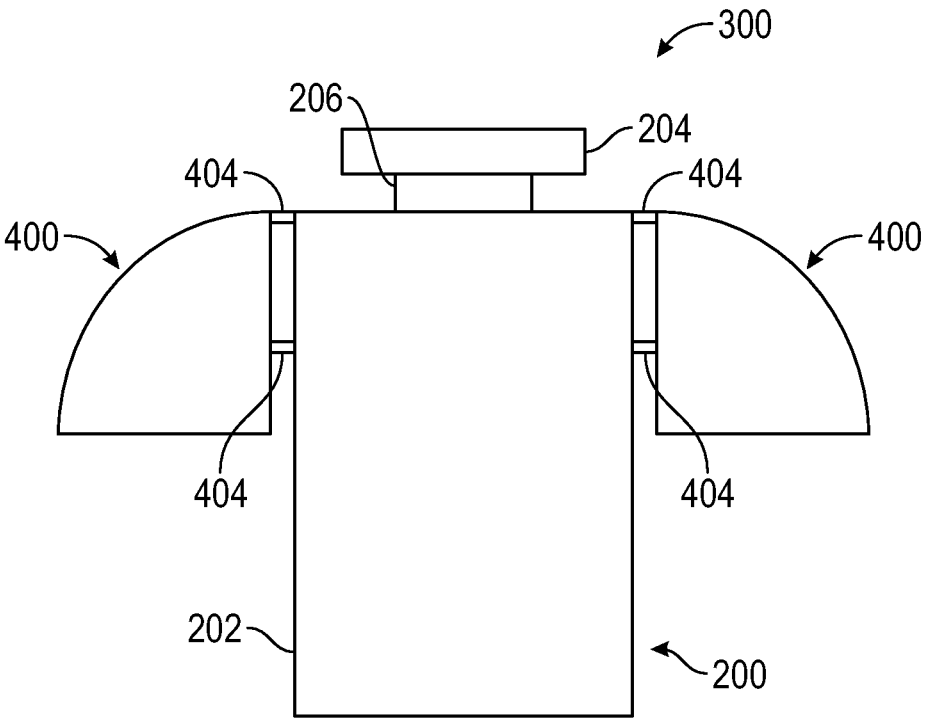
FIG. 13 shows a front view of the neuromuscular training apparatus of FIG. 12.

FIGS. 12 and 13 illustrate a first embodiment of an NTA 300 comprising a trunk mount 200 and two shoulder cups 400. Two shoulder cups 400 are shown with cup bodies 402, however in some embodiments a single shoulder cup 400 may be comprised in NTA 300. As can be seen in the cross-sectional view of FIG. 12, an inner surface of shoulder cup 400 is shaped to conform to an outer surface of a person's shoulder. Various methods may be employed to attach shoulder cup 400 firmly against the person's shoulder such as connectors including straps, ties, adhesives, or other types of attachment which fall within the scope of the invention. Straps 404 connect shoulder cup 400 to trunk mount 400 as shown. In some embodiments, straps 404 may be elastic connections providing a passive tensile force to hold shoulder cup 400 against the person's shoulder. In some embodiments, straps 404 may comprise length sensors which may communicate with the control data computer to monitor the relative position of the shoulder cup 400 and the trunk mount 200. The length sensors may also function to exert a tensile force to hold shoulder cup 400 against the person's shoulder. Various types of length sensors fall within the scope of the invention such as piezoelectric sensors, elastic strain gauges, tape-measure type rotary encoder length gauges, etc.

Second Embodiment of a Neuromuscular Training Apparatus (NTA)

Figure 14:
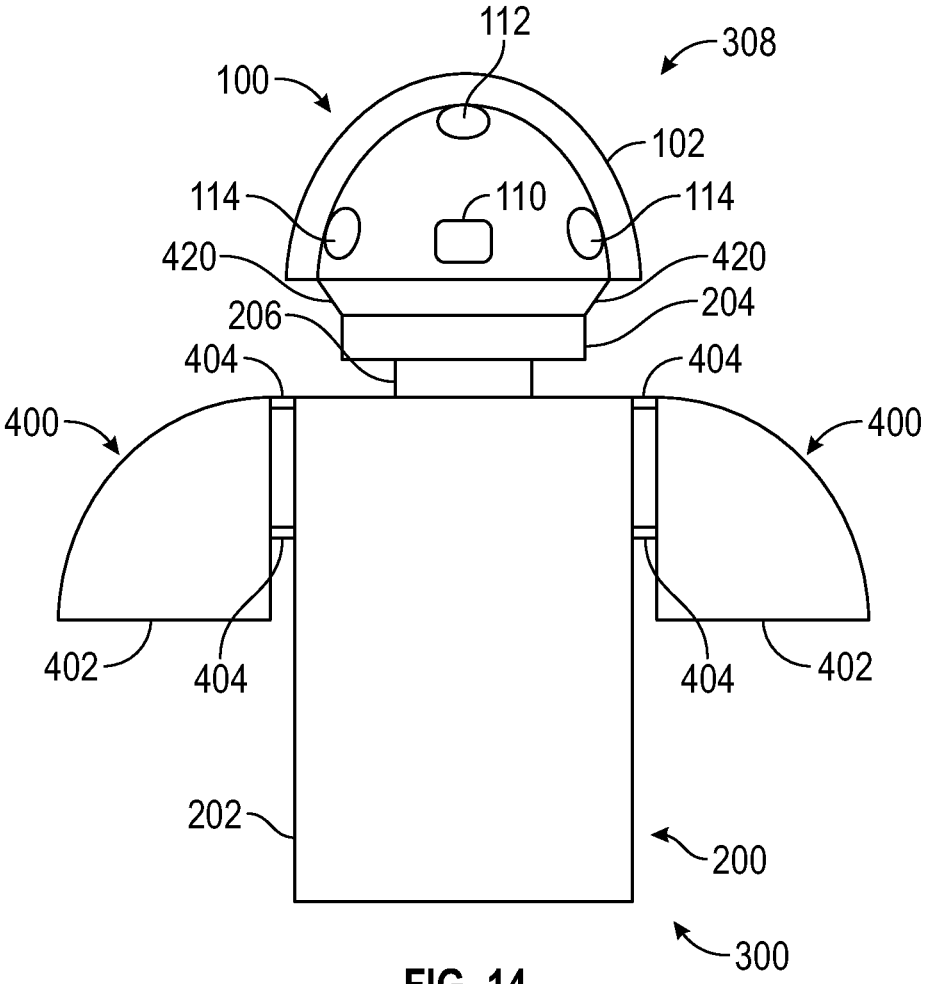
FIG. 14 shows a front view of a second embodiment of a neuromuscular training apparatus.

FIG. 14 shows a front view of a second embodiment of an NTS 308. In this second embodiment, a helmet assembly 100 has been added to the first embodiment 300. Straps 420 connect helmet assembly 100 to neck ring 204. All the same design and operational considerations apply for straps 420 as applied for straps 404.

This second embodiment may perform all the training functions of the first embodiment, as well as a number of additional training functions relating to improved posture and motion of the person's head 106 (not shown here) relative to the person's torso which corresponds to the position of the trunk mount. These motions are discussed above with respect to the helmet assembly.

Third Embodiment of a Neuromuscular Training Apparatus (NTA)

Figure 16:
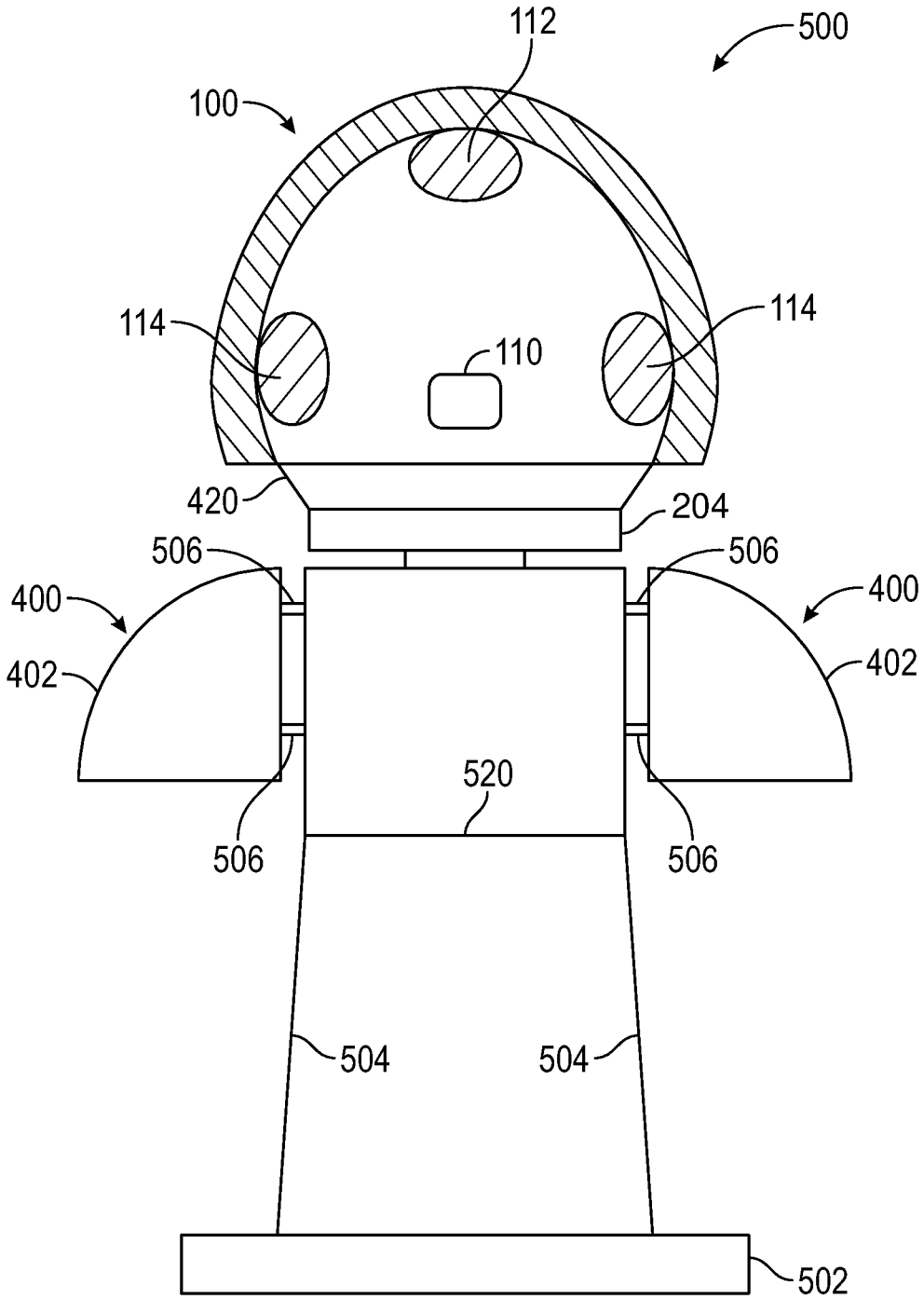
FIG. 16 shows a front view of the neuromuscular training apparatus of FIG. 15.

FIG. 15 shows a cross-sectional front view of a third embodiment of an NTA 500 while being worn by a person undergoing neuromuscular training. FIG. 16 shows a front view of the neuromuscular training apparatus of FIG. 15 but without the person being shown. In the third embodiment 500, a two-piece trunk mount 510 is employed comprising an upper trunk mount 520 and a lower trunk mount 502. Upper trunk mount 520 is connected to the helmet assembly 100 and the shoulder cups 400 similarly as for the second embodiment. Upper trunk mount 520 does not extend as far down the person's torso at the front and back as did trunk mount 200 in the second embodiment. The straps 420 connecting the helmet assembly 100 to the upper trunk mount 502 function the same as in the second embodiment. Similarly, all the straps 506 connecting the shoulder cups 400 to the trunk mount 520 function the same as straps 404 in the second embodiment. Lower trunk mount 502 is attached firmly to the person's lower torso (around the belly) and is connected by straps 504 to upper trunk mount 520. All the same design and operational considerations apply for straps 504 as applied to straps 404 and 420.

Pressure Plate Embodiment

FIG. 17 shows a cross-sectional view of a pressure plate 800, comprising support plate 804, one or more force-exerting devices 806, and sensors 808 attached to one or more of the force-exerting devices 806 as shown. In some embodiments, pressure plate 800 may comprise a sensor 808 on each of the force-exerting devices 806. In some embodiments, pressure plate 800 may comprise sensors 808 on only some or none of the force-exerting devices 806. In FIGS. 1, 3, and 5, the pressure/sensor assemblies 110-114 may be configured as shown here, with a sensor on a surface of the force-exerting device away from a surface of the force-exerting device which is attached the inner surface of the helmet shell 102 instead of the support plate 804.

The pressure plate 800 may function as a robotic hand which applies a strong positive force or a weak positive or weak negative force on the person's torso, legs or head, thereby acting as a stimulus to encourage the person to maintain balance and postural stability while performing an activity such as sit-to-stand. Pressure plate 800 may typically have at least one sensor, and optionally an array of sensors, to measure the change in pressure of the body part against the plate. Various training functions may be performed by pressure plate (or by any or all of pressure/sensor assemblies 110-114:

1. A weak positive (i.e., pushing) force prompts the person being trained to move;
2. A strong positive force allows the person being trained to be partially supported by the pressure plate 800;
3. A weak negative (i.e., pulling) force, that is, moving the pressure plate 800 away from the person slowly, enables the person being trained to attempt to follow the pressure plate 800, maintaining the same pressure while maintaining coordination in the other body parts; for example, a pressure plate may be placed against the back of the person, and then drawn back and down, giving the person a chance to keep his/her back against the plate while sitting down, and while monitoring various other diagnostic information such as the head being pulled back and down.

The neuromuscular training suing embodiments may detect the following features of movement:

1. Resistance to head rotation;
2. Elbow moving up, wrist moving in, wrist moving back;
3. Distortion of the torso (shortening, narrowing);
4. Knees pulling in;
5. Ulnar and radial deviation, and flexion and extension of the wrists;
6. And other relative motions (linear and/or angular) between various body parts.

Pressure Plate Assembly

Figure 18:
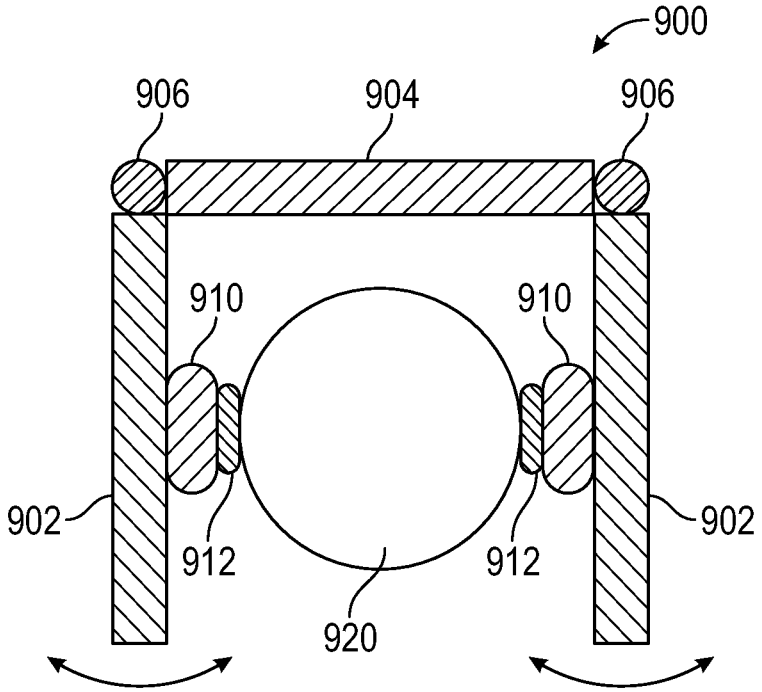
FIG. 18 shows a cross-sectional view of a pressure plate assembly.

FIG. 18 shows a cross-sectional view of a pressure plate assembly 900 comprising multiple pressure plates. The assemblies of support plates 902, force-exerting devices 910, and sensors 912 correspond to the similar elements of pressure plate assembly 800 in FIG. 17. Body part 920 may be any body part, such as an ankle, calf, knee, thigh, hip, wrist, forearm, elbow, upper arm, torso, etc. The two pressure plate assemblies pivotally-attached (arrows) to a connection plate 904 to facilitate wrapping the pressure plate assembly around the corresponding body part as shown.

The pressure plate assembly 900 also provides a wearer with additional proprioceptive feedback by virtue of applying a constant force by being clamped on, and additional and dynamic force through activation of the force-exerting devices 910.

1. Force-exerting devices:
   a. May comprise at least one inflatable and deflatable bladder on each end that is in contact with the body part 920;
   b. Pressure from the force-exerting device may suggest to the person being trained a direction they should move by inflating on one side and deflating on another side to indicate a suggested direction of motion. This may enable giving the person being trained instructions about how and where to move the arms to play a game and/or carry out a training diagnostic;
2. Sensors:
   a. May detect movement/force against a direction of force being applied by a force-exerting device, wherein this force-resistance information may be used for diagnostic purposes.
   b. May comprise an accelerometer to allow angular motion detection in conjunction with other sensors (for example, the combination of acceleration information from a wrist and an elbow). This could enable detection of flexion and extension, as well as ulnar and radial deviation of the wrist, which can be useful diagnostics for excessive muscular activation during activity.
3. Applications of pressure plate assemblies (PPAs):
   a. When held by an external rigid body, a PPA can detect the force applied to the bladder sensor, which is information useful in diagnostics of motor control
   b. When a physical therapist or helper moves the person's hand (optionally via a PPA), the elbow PPA can detect the angle of the elbow, which is a useful diagnostic for excessive muscle activation around the elbow and shoulder joints.

Although the present invention and its advantages have been described in detail, it should be understood that various changes, substitutions and alterations can be made to the embodiments described herein without departing from the scope of the invention as defined by the appended claims. Moreover, the scope of the present application is not intended to be limited to the particular embodiments of the process, machine, manufacture, composition of matter, means, methods and steps described in the specification.

As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

I claim as follows:

1. A method for automating neuromuscular training of a person, comprising, applying a stimulus to the person being trained by using a Neuromuscular Training Apparatus (NTA) comprising:

a trunk mount, including:

a lower trunk mount;

an upper trunk mount; and a first multiplicity of connectors, each connector having a first end and a second end;

wherein the first ends of the connectors are attached to the lower trunk mount, and the second ends of the connectors are attached to the upper trunk mount, wherein the connectors comprising sensors that are configured to measure a relative orientation of the upper trunk mount to the lower trunk mount; and a helmet assembly, the helmet assembly being attached to the trunk mount;

sensing responses of the person being trained by using the NTA;

evaluating the responses of the person being trained; and modifying the stimulus on the basis of the evaluation, wherein the stimulus is applied to the person being trained with a dynamic pressure plate, which contacts one or more body parts of the person being trained to apply forward pressure to elicit motor responses for maintaining postural integrity and balance while detecting whether the person being trained is able to make adjustments while maintaining a pressure of the one or more body parts against the dynamic pressure plate constant, or to apply backward pressure to allow the person being trained to attempt to match movement of the dynamic pressure plate while maintaining the pressure of the one or more body parts against the dynamic pressure plate constant.

2. The method of claim 1, wherein an attachment of the helmet assembly is a fixed attachment.

3. The method of claim 1, wherein the NTA further comprises a multiplicity of sensors operable to detect movement of the helmet assembly relative to the trunk mount.

4. The method of claim 1, wherein the NTA further comprises:

a shoulder cup; and a multiplicity of sensors operable to detect movement of the shoulder cup with respect to the trunk mount.

5. The method of claim 1, wherein the NTA further comprises a multiplicity of sensors operable to detect relative movement between the upper trunk mount and the lower trunk mount.

6. The method of claim 1, wherein an attachment between the helmet assembly and the upper trunk mount comprises a second multiplicity of connectors, each connector having a first end and a second end, wherein the first ends of the second multiplicity of connectors are attached to the upper trunk mount, and the second ends of the second multiplicity of connectors are attached to the helmet assembly, wherein the second multiplicity of connectors comprising sensors that are configured to measure a relative orientation of the upper trunk mount to the helmet assembly.

7. The method of claim 1, further comprising:

applying a second stimulus to the person being trained by using the NTA;

sensing responses of the person being trained by using the NTA;

evaluating the responses of the person being trained; and modifying the second stimulus on a basis of an evaluation.

8. The method as in claim 7, wherein the second stimulus is applied to multiple body parts of the person being trained simultaneously.

9. A method for automating neuromuscular training of a person, comprising, applying a stimulus to the person being trained by using a Neuromuscular Training Apparatus (NTA) comprising:

a trunk mount, including:

a lower trunk mount;

an upper trunk mount; and a first multiplicity of connectors, each connector having a first end and a second end;

wherein the first ends of the connectors are attached to the lower trunk mount, and the second ends of the connectors are attached to the upper trunk mount, wherein the connectors comprising sensors that are configured to measure the relative orientation of the upper trunk mount to the lower trunk mount; and a helmet assembly, the helmet assembly being attached to the trunk mount;

sensing responses of the person being trained by using the NTA;

evaluating the responses of the person being trained; and modifying the stimulus on the basis of the evaluation, wherein the stimulus is applied to the person being trained with a dynamic pressure plate, which contacts one or more body parts of the person being trained to apply forward pressure to elicit motor responses for maintaining postural integrity and balance while detecting whether the person being trained is able to make adjustments while maintaining a pressure of the one or more body parts against the dynamic pressure plate constant, or to apply backward pressure to allow the person being trained to attempt to match movement of the dynamic pressure plate while maintaining the pressure of the one or more body parts against the dynamic pressure plate constant; the dynamic pressure plate is configured to support partially the person's weight or the dynamic pressure plate is not configured to support partially the person's weight, wherein the stimulus is applied to multiple body parts of the person being trained simultaneously.

* * * * *